United States Patent [19]

Boggs et al.

[11] 4,111,356

[45] Sep. 5, 1978

[54] CENTRIFUGAL APPARATUS WITH FLEXIBLE SHEATH

[75] Inventors: Daniel R. Boggs, Vernon Hills; Richard I. Brown, Northbrook, both of Ill.

[73] Assignee: Baxter Travenol Laboratories, Inc., Deerfield, Ill.

[21] Appl. No.: 815,095

[22] Filed: Jul. 13, 1977

[51] Int. Cl.[2] ..... B04B 9/08

[52] U.S. Cl. ..... 233/26

[58] Field of Search ..... 233/23 R, 24, 25, 26, 233/1 R, 27; 64/2 R; 74/797

[56] References Cited

U.S. PATENT DOCUMENTS

| | | | |
|---|---|---|---|
| 3,586,413 | 6/1971 | Adams | 64/2 R |
| 3,986,442 | 10/1976 | Khoja | 74/797 |

*Primary Examiner*—George H. Krizmanich
*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment is fixed at one end substantially along the axis of the processing chamber at one side thereof, with the other end of the cable segment being attached substantially on the axis in rotationally locked engagement to the processing chamber. Frictional heating and drag of the umbilical cable segment during rotation thereof is alleviated by providing a flexible sheath having a variable radius which defines an outer surface contour conforming to the inner wall surface of a curved support to thereby provide non-slipping rotary motion of the umbilical cable segment.

7 Claims, 6 Drawing Figures

FIG. 3
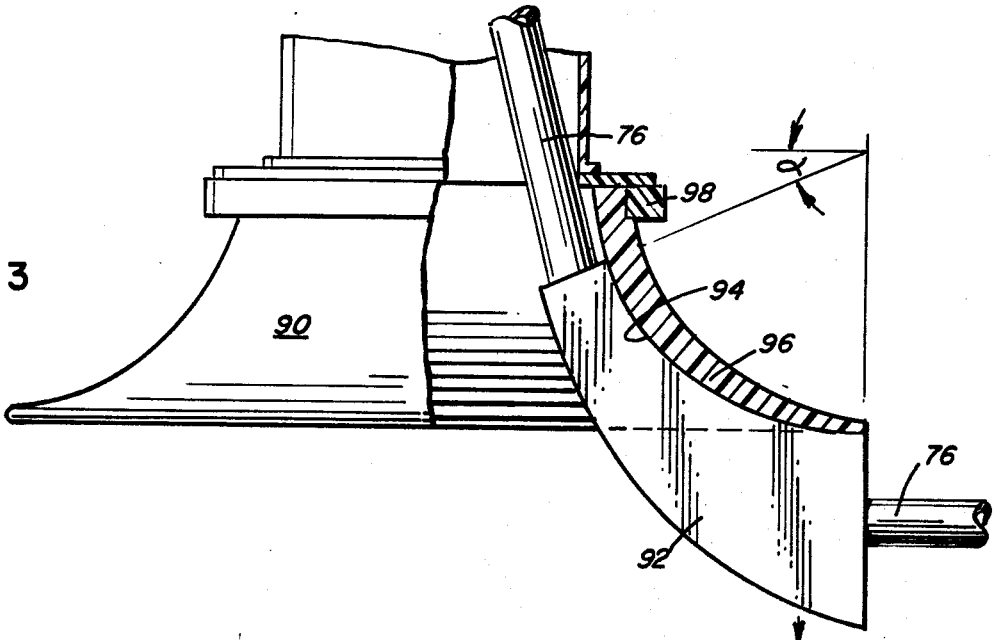
FIG. 4
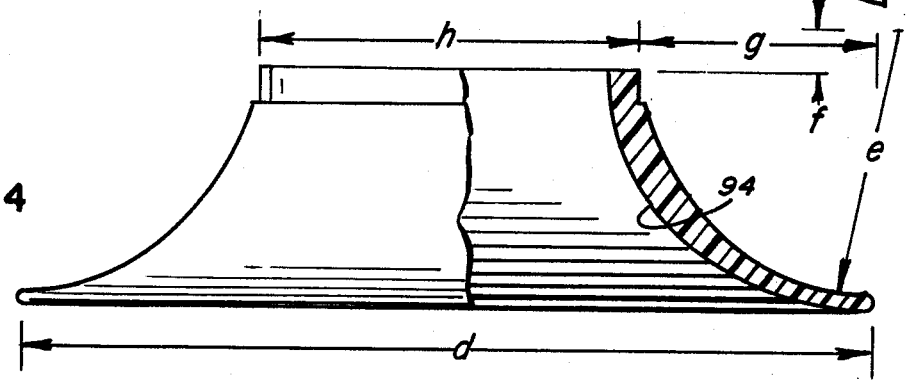
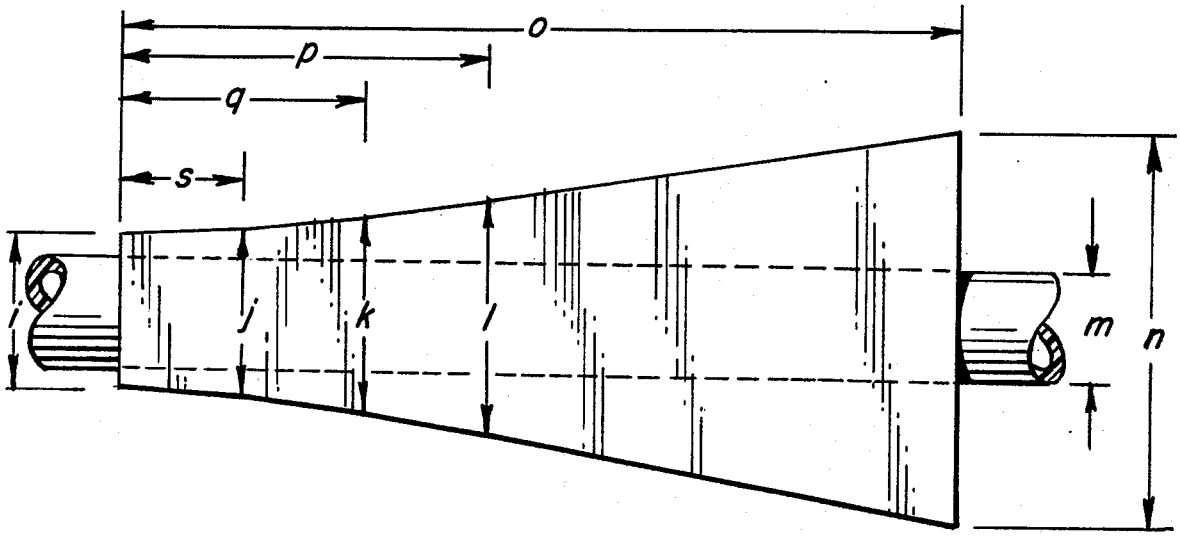
FIG. 5

CENTRIFUGAL APPARATUS WITH FLEXIBLE SHEATH

BACKGROUND OF THE INVENTION

The present invention concerns centrifugal processing apparatus, and more particularly, apparatus employing umbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining red blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

It has been found that significant frictional heating and drag is experienced by the umbilical tube as it contacts guide portions of the centrifuge. To alleviate these difficulties, lubrication has been provided which is helpful, but such lubrication requires frequent replacement.

Some constructions have utilized a free rotating guide through which the umbilical tube extends. Typically the tube at high speed may rotate about the centrifuge axis at 1,500 rpm. Since the guide is freely rotating at a speed determined by the surface speed of the umbilical tube at the point of highest loading, surface speeds at all other points along the free rotating guide will be mismatched, causing frictional heating and drag.

It is, therefore, an object of the invention to provide means for alleviating the friction heating and drag experienced by the umbilical tube during rotation thereof as it contacts guide portions of the centrifuge.

Another object of the present invention is to provide a frictional heating and drag reducing system which does not require lubrication for its operability.

A further object of the present invention is to provide a frictional heating and drag reducing system for the umbilical tube of a rotating centrifuge, in which special treatment of metal parts is unnecessary.

A still further object of the present invention is to provide a friction reducing method for rotating umbilical tubing in a rotating centrifuge in which build-up of abrasion products resulting from low friction surfaces is avoided.

Another object of the present invention is to provide a friction reducing system which is efficient in operation and relatively inexpensive to construct.

Other objects and advantages of the present invention will become apparent as the description proceeds.

BRIEF DESCRIPTION OF THE INVENTION

In accordance with the present invention, centrifugal processing apparatus is provided which comprises a stationary base and a processing chamber rotatably mounted with respect to the base for rotation about a predetermined axis. A flexible umbilical cable segment is provided for establishing fluid communication with the processing chamber. One end of the cable segment is fixed with respect to the base substantially along the axis at one side of the processing chamber. The other end of the cable segment is attached substantially on the axis in rotationally locked engagement to the processing chamber.

A guide member is located along the cable segment. The guide member comprises a downwardly and outwardly tapering tubular support having an inner wall which defines an internal opening for receiving the cable segment. A sheath surrounds the cable segment. The sheath has an outer surface contour which conforms to the inner wall surface of the tubular support so that the outer surface and inner wall surface are substantially matched.

The radius of the sheath is variable along the length of the sheath so that the linear velocity of the sheath surface substantially matches the linear velocity of the inner wall surface. Means are provided for rotating the fluid processing chamber and the cable segment in the same direction with a speed ratio of 2:1, respectively.

In the illustrative embodiment, the guide member is freely rotatable about a substantially vertical axis and is driven by the sheath. The sheath is formed integrally with the cable segment in one embodiment while in another embodiment the sheath is rigidly bonded to the cable segment.

A more detailed explanation of the invention is provided in the following description and claims, and is illustrated in the accompanying drawings.

BRIEF DESCRIPTION OF THE DRAWINGS

FIG. 3 is a fragmentary elevational view, partially broken and taken in cross-section for clarity, of a guide member and flexible sheath constructed in accordance with the principles of the present invention;

FIG. 4 is an elevational view, taken partially in cross-section for clarity, of a guide member constructed in accordance with the principles of the present invention;

FIG. 5 is a front view of a flexible sheath constructed in accordance with the principles of the present invention.

DETAILED DESCRIPTION OF THE ILLUSTRATIVE EMBODIMENT

Figure 1:
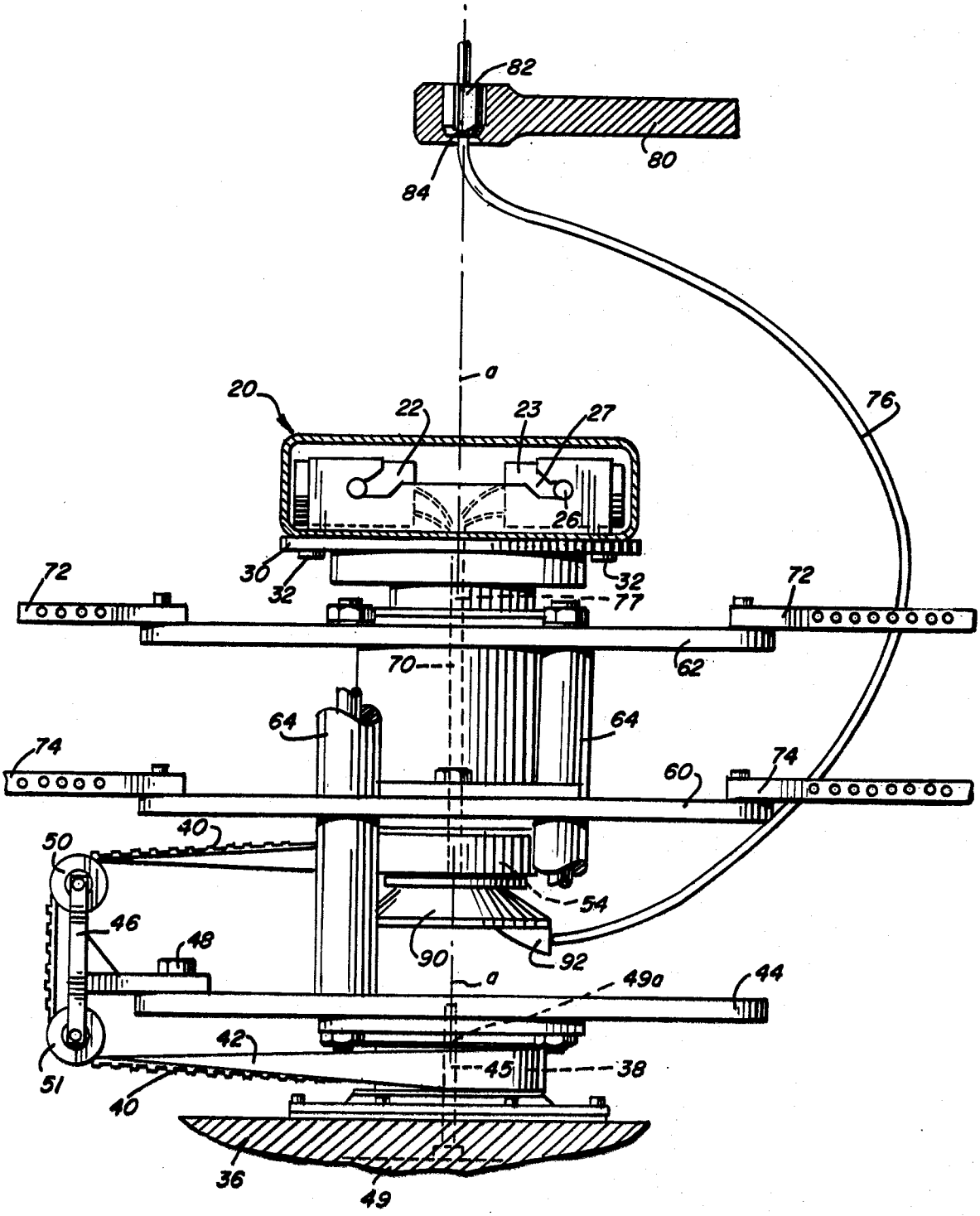
FIG. 1 is a fragmentary elevational view, partially in cross-section, of a centrifugal, apparatus employing the principles of the present invention.

Referring to FIG. 1, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 20. Processing chamber 20 includes a pair of support cups 22, 23, which are mounted in diametrically opposed positions. A pin 26 and slot 27 arrangement is provided to allow easy attachment and removal of the support cups.

Processing chamber 20 is rigidly fastened to a chamber support 30 by suitable fastening means 32.

A stationary base 36 is provided, including a fixed pulley 38 fastened thereto and including teeth which mesh with teeth 40 carried on the pulley-engaging surface of an endless belt 42. A first plate 44, which is rotatable about axia *a*, supports an idler pulley carriage 46 which is fastened to the first plate by suitable fastening means 48. First plate 44 is driven by a motor 49 positioned within the stationary base 36, the shaft 49*a* of which is coaxial with axis *a* and extends through an axial bore 45 defined by fixed pulley 38.

Figure 2:
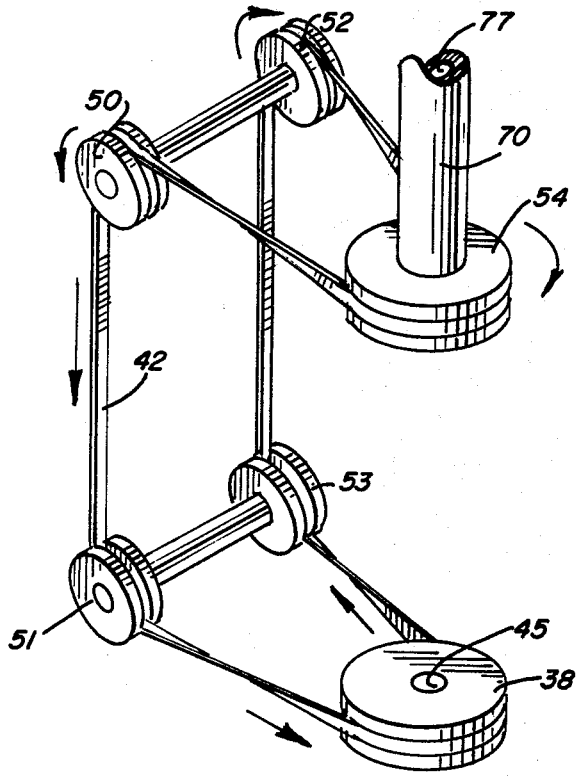
FIG. 2 is a diagrammatic view of the belt drive mechanism for the apparatus of FIG. 1.

Pulley carriage 46 includes four idler pulleys 50, 51, 52 and 53. As shown in FIG. 2, pulleys 51 and 53 are laterally spaced from each other and pulleys 50 and 52 are laterally spaced from each other, with drive belt 42 being routed over these pulleys from the fixed pulley 38 to a main drive pulley 54 which serves to drive support platform 32 and the attached processing chamber 20.

A second plate 60 and a third plate 62 are ganged to first plate 44 by means of four posts 64. Posts 64 are fastened to the first and third plates through the second plate and are spaced symmetrically about axis of rotation *a*. Thus when first plate 44 is driven by the motor within stationary base 36, second plate 60, third plate 62 and pulley carriage 46 will all rotate together about axis *a* at the same speed.

Main drive pulley 54 is keyed to a hollow shaft 70 which extends through and is keyed to support platform 30. Thus rotation of pulley 54 will cause rotation of processing chamber 20.

In operation, when the motor 49 is actuated, drive belt 42 establishes a clockwise rotation of plates 44, 60, 62 and pulley carriage 46. With fixed pulley 38 and main drive pulley 54 having the same diameter, the rotational speed of processing chamber 20 will be exactly twice that of plates 44, 60 and 62, by reason of the combined effect of the direct 1:1 drive relationship established by pulleys 54 and 38 and the planetary motion of idler pulleys 50-53 about the rotational axis *a*. The drive belt 42 and pulleys utilized to drive the system may be conventional cog belts and pulleys of the type commonly used for timing applications where slippage is to be avoided.

Extending members 72, 74 are attached to plates 62, 60, respectively, and may serve to guide umbilical cable or tubing 76, which will be described in more detail below. Members 72, 74 may carry a large support tube through which umbilical cable 76 extends, although it has been found that during operation of the system such support tubing is unnecessary. However, it is important that umbilical cable 76 rotate at one-half the speed of processing chamber 20 and thus plates 60 and 62 form a rotational system having a first angular velocity while processing chamber 20 forms a second rotational system having twice the first rotational velocity. It is noted that an example of centrifugal processing apparatus having a drive similar to the drive illustrated in FIGS. 1 and 2 of the instant application is disclosed in the copending application of Houshang Lolachi, Ser. No. 657,187, filed Feb. 11, 1976, with particular reference to FIG. 11 thereof. It is to be understood, however, that various other drive mechanisms may be employed to cause the appropriate relative rotation between processing chamber 20 and umbilical cable 76 of a 2:1 angular velocity ratio.

Fluid communication with the support cups 22 and 23, which rotate as part of the processing chamber 20 and with the non-rotating portions of the centrifugal processing system, is provided by the umbilical cable or tubing 76. Cable 76 defines separate passageways or conduits therein. Although four lumen tubing is preferable, it is to be understood that no limitation with respect to the particular size of the cable or the number of passageways is intended or should be implied. Further, tubing 76 could be circular or polygonal in cross-sectional configuration.

Cable 76 is suspended from a point above and axially aligned with processing chamber 20 by means of a stationary or fixed torque arm 80. A collar 82, fastened to cable 76, is fixed to torque arm 80. A similar collar (not shown) is fastened to cable 76 and fixed to axis *a* below the processing chamber. Cable 76 carries four tubes which extend to the interior of support cups 22, 23.

It can be seen that a segment of cable 76 extends downwardly from an axially fixed position 84, extending radially outwardly, downwardly and around, and then radially inwardly and upwardly back to the processing chamber. The cable 76 extends through a central bore 77 defined by pulley 54 and shaft 70 keyed to that pulley, through support plate 30 and up into processing chamber 20 for fluid communication with support cups 22 and 23.

In order to alleviate frictional heat and drag experienced at the area in which the cable 76 is curved upwardly, a rotating guide member 90 is provided and is freely rotatable about axis *a*. Cable 76 carries a flexible sheath 92 for cooperating with the inner wall of guide member 90 in a manner whereby the outer surface contour of the flexible sheath 92 conforms to the inner wall surface 94 of guide member 90.

As shown most clearly in FIG. 3, curved inner wall 94 forms a matching engagement with a portion of the outer surface 96 of flexible sheath 92. Thus, radius of flexible sheath 92 is variable along its length so that the outer surface 96 and the inner wall surface 94 are substantially matched. By providing a flexible sheath, formed of silicone rubber or the like, with a variable radius along the length of the sheath in a manner to be described below, the linear velocity of the sheath surface substantially matches the linear velocity of the inner wall surface. In this manner, the frictional heating and drag resulting from mismatching surfaces will be alleviated and no lubrication is required for the operability of the system.

Since the guide member 90 is freely rotatable within bearing 98, rotation of umbilical cable 76 effectively causes following rotation of guide member 90 at the same velocity as the flexible sheath, with the problem of slippage being alleviated.

Figure 6:
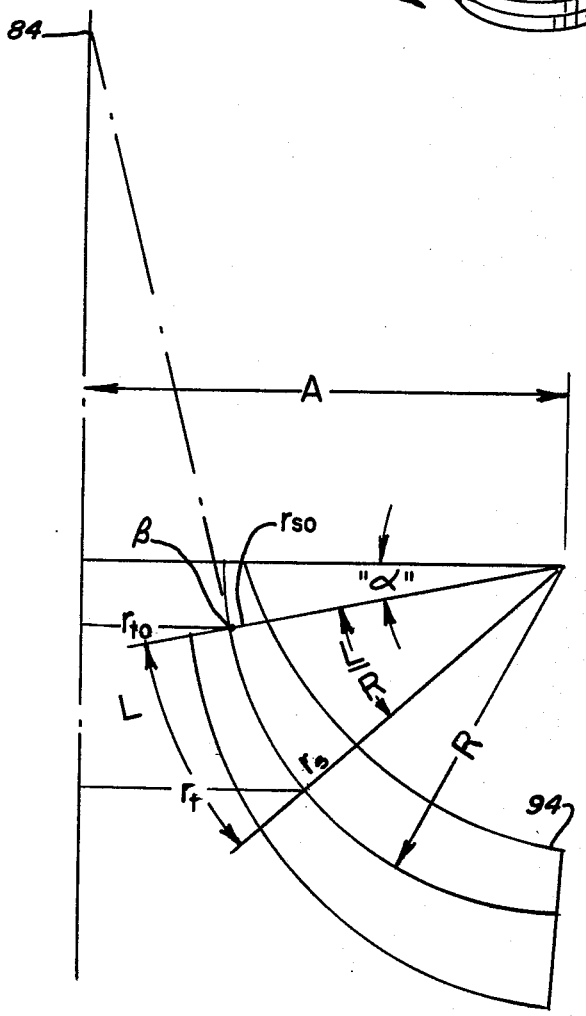
FIG. 6 is a diagram to aid in showing a mathematical relationship between the parts of the illustrative embodiment.

As a specific example with respect to the derivation of satisfactory parameters for guide member inner surface 94 and the length and radii of flexible sheath 92, reference is made to FIG. 6 in particular. The illustrative example begins with the specification that the center line of the tube describes an arc of a circle. However, the method is well adapted to provide a sheath design that will accommodate any desired umbilical center line path. In FIG. 6, "A" is the distance of the tube 76 curvature center from the axis *a* of rotation. Thus, *b* represents the center line of tube 76 which is coaxial with flexible sheath 92, the flexible sheath being symmetrical about tube center line *b*. "A" represents the distance from the center of the circle (of which *b* is an arc thereof) to the axis of rotation *a*.

"R" represents the desired radius of curvature of the tube axis *b*. "$r_s$" is the sheath radius of any point along the length of the sheath and is given by the formula $$r_s = \frac{A - R\,\mathrm{Cos}\left(\alpha + \frac{L}{R}\right)}{\frac{r_{to}}{r_{so}} + \mathrm{Cos}\,\alpha - \mathrm{Cos}\left(\alpha + \frac{L}{R}\right)}$$

"L" is the length along the sheath (as measured from its origin "$\beta$") for which the sheath radius "$r_s$" is desired. "$\alpha$" is the angle (as measured from the horizontal) at which the sheath origin $\beta$ lies along the tube axis *b*. The angle "$\alpha$", and thus the location of the sheath origin "$\beta$", is selected to satisfy the geometrical restraints imposed on the system through the necessity of anchoring the collar 82 to the axis of rotation of the chamber support 30. "$r_{to}$" is the distance from the axis of rotation *a* to the tube axis *b* at the sheath origin "$\beta$". "$r_{so}$" is the radius of the sheath at the sheath origin "$\beta$" and is typically selected to be as small as practicably possible.

It is further seen that the coordinates of the inner wall 94 of the rotating guide member 90 are now directly generated by trigonometric means.

An illustrative example of a guide member 90 and conical sheath 92, showing dimensions based upon the above-mentioned formula, is shown in FIGS. 4 and 5. It is to be understood that these dimensions are for illustrative purposes only and that no limitation is intended with respect thereto. The dimensions on the guide member 90 and flexible sheath 92 of FIGS. 4 and 5, respectively, are:

| Dimension | Value (in inches) |
|---|---|
| d | 5.58 dia. |
| e | 1.75 |
| f | 0.25 |
| g | 1.72 |
| h | 2.5 dia. |
| i | 0.498 dia. |
| j | 0.554 dia. |
| k | 0.640 dia. |
| l | 0.758 dia. |
| m | 0.350 dia. |
| n | 1.272 dia. |
| o | 2.742 |
| p | 1.20 |
| q | 0.8 |
| s | 0.4 |
| $\alpha$ | .192 radians (11 degrees) |

Flexible sheath 92 is attached to tubing 76 by suitable bonding techniques, or the sheath may be formed integrally with the tubing. It is important that the flexible sheath and tubing be connected in a manner so that there is no relative rotation or movement between them. When the system is in place as illustrated in FIG. 3, rotation of the umbilical cable 76 will be followed by rotation of guide member 90 and the matching surfaces of flexible sheath 92 and the inner wall 94 of guide member 90 will alleviate the frictional heat and drag problems associated with a less effective system.

Although an illustrative embodiment of the invention has been shown and decribed, it is to be understood that various modifications and substitutions may be made by those skilled in the art without departing from the novel spirit and scope of the present invention.

What is claimed is:

1. Centrifugal processing apparatus, which comprises:

a stationary base;

a processng chamber rotatably mounted with respect to said base for rotation about a predetermined axis;

a flexible umbilical cable segment for establishing fluid communication with said processing chamber, one end of said cable segment being fixed with respect to said base substantially along said axis at one side of said processing chamber, the other end of said cable segment being attached substantially on said axis in rotationally locked engagement to said processing chamber;

a guide member located along said cable segment, said guide member comprising a downwardly and outwardly tapering tubular support having an inner wall which defines an internal opening for receiving said cable segment;

a sheath surrounding said cable segment, said sheath having an outer surface contour conforming to the inner wall surface of the tubular support so that said outer surface and inner wall surface are substantially matched;

the radius of said sheath being variable along the length of said sheath so that the linear velocity of the sheath surface substantially matches the linear velocity of the inner wall surface; and means for rotating said fluid processing chamber and said cable segment in the same direction with a speed ratio of 2:1, respectively.

2. Centrifugal processing apparatus as described in claim 1, wherein said sheath is formed integrally with said cable segment.

3. Centrifugal processing apparatus as described in claim 1, wherein said sheath is rigidly bonded to said cable segment.

4. Centrifugal processing apparatus as described in claim 1, wherein said guide member is freely rotatable about a substantially vertical axis and is driven by said sheath.

5. Centrifugal processing apparatus, which comprises:

a stationary base;

a processing chamber rotatably mounted with respect to said base for rotation about a predetermined axis;

a flexible umbilical cable segment for establishing fluid communication with said processing chamber, one end of said cable segment being fixed with respect to said base substantially along said axis at one side of said processing chamber, the other end of said cable segment being attached substantially on said axis in rotationally locked engagement to said processing chamber;

a guide member located along said cable segment;

said guide member comprising a downwardly and outwardly tapering tubular support having an inner wall which defines an internal opening for receiving said cable segment;

a sheath surrounding said cable segment;

said sheath having an outer surface contour conforming to the inner wall surface of said guide member so that said outer surface and inner wall surface are substantially matched;

the radius of said sheath being variable along the length thereof so that the linear velocity of the sheath surface substantially matches the linear velocity of the respective inner wall surface;

said guide member being freely rotatable about a substantially vertical axis and being driven by said sheath; and means for rotating said fluid processing chamber and said cable segment in the same direction with a speed ratio of 2:1, respectively.

6. Centrifugal processing apparatus as described in claim 5, wherein said sheath is formed integrally with said cable segment.

7. Centrifugal processing apparatus as described in claim 5, wherein said sheath is rigidly bonded to said cable segment.

* * * * *